United States Patent [19]

Malmström

[11] Patent Number: 4,578,254

[45] Date of Patent: Mar. 25, 1986

[54] PROCESS FOR THE REFINING OF SULFIDIC CONCENTRATES WHICH CONTAIN ARSENIC, ANTIMONY AND BISMUTH

[75] Inventor: Rolf Malmström, Helsinki, Finland

[73] Assignee: RM Metal Consulting Ky, Helsinki, Finland

[21] Appl. No.: 665,380

[22] Filed: Oct. 26, 1984

[30] Foreign Application Priority Data

Oct. 27, 1983 [FI] Finland ..... 833940

[51] Int. Cl.[4] ..... C01B 27/00; C01B 29/00

[52] U.S. Cl. ..... 423/88

[58] Field of Search ..... 423/88

[56] References Cited

U.S. PATENT DOCUMENTS

| | | | |
|---|---|---|---|
| 2,867,526 | 1/1959 | Heath et al. | 423/88 |
| 3,220,796 | 11/1965 | Espinosa | 423/88 |
| 4,083,924 | 4/1978 | Styring | 423/88 |
| 4,497,780 | 2/1985 | Barin et al. | 423/565 |

*Primary Examiner*—John Doll
*Assistant Examiner*—Wayne A. Langel
*Attorney, Agent, or Firm*—Oblon, Fisher, Spivak, McClelland & Maier

[57] ABSTRACT

The invention relates to a process for the refining of sulfidic concentrates which contain arsenic, antimony and bismuth, wherein a suspension of the sulfidic concentrate and oxygen or oxygen-enriched air is introduced into the upper part of a reaction zone, in the lower part of which the direction of the gases is deflected sidewards in order to cause the molten and solid particles traveling along with the gases to impinge against the surface of the melt below the reaction zone. In order to form a molten or semi-solid phase, concentrate, oxygen or oxygen-enriched air, and a carbon- or sulfur-containing fuel are introduced into the reaction zone in such proportions that in the upper part of the reaction zone there is formed an atmosphere containing sulfur and sulfur dioxide and having a temperture above 900° C. and a maximum oxygen pressure of $10^{-6}$ atm in order to volatilize the arsenic, antimony and bismuth, and possibly the lead and zinc. During the same stage, air or oxygen-enriched air is fed into the lower part of the reaction zone in order to oxidize the concentrate to the desired metal concentration.

6 Claims, 1 Drawing Figure

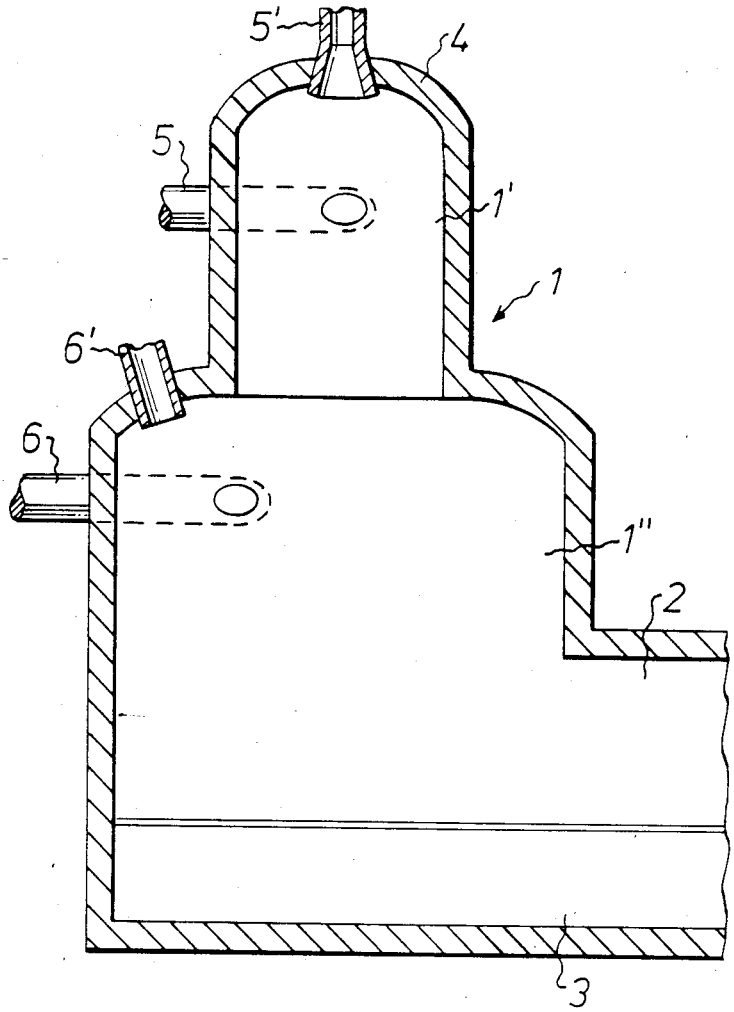
5'
4
5
1'
1
6'
6
1"
2
3

PROCESS FOR THE REFINING OF SULFIDIC CONCENTRATES WHICH CONTAIN ARSENIC, ANTIMONY AND BISMUTH

BACKGROUND OF THE INVENTION

The present invention relates to a process for the refining of sulfidic concentrates which contain arsenic, antimony and/or bismuth, wherein a suspension of sulfidic concentrates and oxygen, and possibly oxygen-enriched air, is introduced into the upper part of the reaction zone, in the lower part of which the direction of the gases is deflected sidewards in order to cause the molten and solid particles traveling along with them to impinge against the surface of the melt below the reaction zone.

A process is known from U.S. Pat. No. 1 762 867 for the treatment of complex ores which contain metal sulfide, wherein the ore is heated for a selective evaporation of the metal sulfides, a reducing atmosphere being maintained within the raw material and directly above it, and an oxidizing atmosphere further above. When necessary, sulfur can be added to the raw material. The smelting of the raw material and its oxidation to the desired metal concentration must, however, be carried out in a separate stage.

FI-Pat. No. 56 196 discloses a process for bringing the impurities, such as arsenic, antimony and bismuth, present in sulfidic complex and mixed ores and concentrates into an easily removable form, wherein the minerals of the raw material are broken up and rearranged at temperatures below 900° C. and at a high partial pressure of elemental sulfur, i.e. 0.2–1 atm, in such a way that new, easily volatilizing independent sulfide compounds are formed, which can be in part volatilized in the same stage.

This prior known process has a disadvantage in that by means of it the impurities of the raw material are only brought to an easily removable form, whereas the actual smelting must be carried out in a separate stage.

The object of the present invention is to eliminate this disadvantage and to provide a process for the removal of arsenic, antimony and bismuth from sulfidic concentrates and for the smelting of the matte in one single stage, for example in the reaction shaft of a flash smelting furnace.

SUMMARY OF THE INVENTION

In accordance with the present invention, a molten or semisolid phase is formed of the sulfide concentrate in the cylindrical reaction zone by introducing into the reaction zone concentrate, oxygen or oxygen-enriched air, and possibly a carbon- and sulfur-containing fuel in such proportions that in the upper part of the reaction zone there is formed an atmosphere containing sulfur and sulfur dioxide and having a temperature above 900° C. and a maximum oxygen pressure of $10^{-6}$ atm for the volatilization of the arsenic, antimony and bismuth. Thereafter the concentrate is oxidized during the same stage to the desired metal concentration by feeding air or oxygen-enriched air into the lower part of the reaction zone.

According to a preferred embodiment of the present invention, concentrate, oxygen or oxygen-enriched air, and possibly a carbon- and/or sulfur-containing fuel are fed into the upper part of the reaction zone in such proportions that a temperature of 1200°–1300° C. prevails in the upper part of the reaction zone.

DESCRIPTION OF THE DRAWING

The FIGURE illustrates a cross-sectional partial vertical representation of a modified flash smelting furnace suitable for carrying out the process according to the invention.

DETAILED DESCRIPTION OF THE PREFERRED EMBODIMENT

In the FIGURE, the upright cylindrical reaction shaft of the flash smelting furnace is indicated by reference numeral 1, and its lower end joins the lower furnace 2. The reaction shaft 1 is divided into two zones one above the other, i.e. the upper part 1' having a smaller diameter and the lower part 1''. As in prior known flash smelting furnaces, the suspension of concentrate and gas can be fed in from the upper end 4 of the reaction shaft 1 via the pipe 5' or alternatively via the pipe 5 meeting the upper part 1' of the reaction shaft 1 tangentially.

According to the present invention, in the upper part 1' of the reaction shaft a reducing and sulfidizing atmosphere is maintained, having a temperature above 900° C. and a maximum oxygen pressure of $10^{-6}$ atm. The partial pressure of oxygen can, of course, owing to unsatisfactory mixing, be higher outside the actual reactions areas. In these conditions the arsenic, antimony and bismuth of the concentrate volatilize, and thereafter the raw material can be oxidized to the desired metal concentration by feeding air or oxygenenriched air via the pipe 6' fitted in the top of the lower part 1'' of the reaction shaft 1 or via the pipe 6 directed either radially or tangentially through the wall of the lower part 1'' of the reaction shaft 1.

It is known that, for example, in non-oxidizing conditions arsenic volatilizes at 600°–900° C. as a sulfide and above this temperature in elemental form, provided that the gas atmosphere is sufficiently reducing and sulfidizing. This occurs with an arsenic-containing copper concentrate at a temperature of 1250° C., if the oxygen pressure in the surrounding gas is in the order of $10^{-6}$ atm and the sulfur pressure $10^{-3}$ atm. A situation of this type can, according to the invention, be produced in a suspension of gas and concentrate in a chamber resembling the reaction shaft of a flash furnace, by using a proportion of the pyritic sulfur present in the concentrate for the combustion and by leaving a sufficient quantity in order to maintain the sulfur pressure in the atmosphere. If there is free pyrite in the concentrate, even the entire heat amount required can be produced by burning pyrite with technical oxygen. Since, however, the pyritic share of chalcopyrite is not sufficient for maintaining both the temperature and gas atmosphere must be produced by burning hydrocarbon or carbon with the aid of oxygen (the use of air is possible but produces large amounts of gas). If no pyritic sulfur is present in the concentrates, it is possible to use elemental sulfur or the like for the combustion in order to produce a suitable sulfur pressure (for example, concentrates which contain copper glance and enargite, and nickel concentrates which contain pentlandite and arsenic pyrites).

The same procedure can be used for concentrates in which the impurities are antimony and bismuth. Also lead and zinc volatilize excellently in these conditions.

The melt in suspension can be separated in a manner known from the flash smelting process, thereby producing a relatively low-grade matte, depending, or course, on the copper concentrations in the concentrates. The gases which contain the volatilized constituents in the form of sulfides or metals can be treated in many ways.

If a low-grade matte is produced in the shaft, this matte can be oxidized further in the lower part of the shaft by using an addition of air. Thereby the gaseous constituents present in the gas phase are easily converted to oxides, but owing to the high temperature they remain gaseous (with the exception of zinc oxide). In the cooling of the gases, as always when the question is of substances such as these, care must be taken that there are no air leaks before the actual dusts derived from the concentrates have been separated. The separation of these dusts derived from the concentrates is carried out best at as high a temperataure as is allowed by the structure of the electro-filters, whereafter the metals condensing at different temperatures can be separated selectively by, for example, using electrofilters or the like operating at different temperatures. In addition, the amount of dust could be decreased by using the cyclone effect in the additional oxidation in the rising shaft.

EXAMPLE

200 $Nm^3/h$ of technical oxygen, 50 kg/h of oil, and 1 t/h of a sulfidic copper concentrate having an As concentration of 0.7% were fed into the trial furnace. The temperature in the upper part of the shaft was 1250° C., and the prevailing $P_{O2} = 10^{-9}$ atm and $P_{S2} = 10^{-2}$ atm. In addition, approximately 700 $Nm^3/h$ of air was fed into the lower part of the reaction shaft. The concentration of Cu in the produced matte was 57% and its As concentration 0.013%, so the volatilization of As was 98%.

What is claimed is:

1. A process for the refining of sulfidic concentrates which contain at least one element selected from the group consisting of arsenic, antimony and bismuth, wherein a suspension of a sulfidic concentrate and at least one gas selected from the group consisting of oxygen and oxygen-enriched air is introduced into the upper part of a reaction zone, in the lower part of which the direction of the gases is deflected sidewards in order to cause molten and solid particles traveling along with the gases to impinge against the surface of the melt below the reaction zone, comprising introducing, in order to form a molten or semi-solid phase, the concentrate, the gas into the reaction zone in such proportions that in the upper part of the reaction zone there is produced an atmosphere containing sulfur and sulfur dioxide and having a temperature above 1200° C. and a maximum oxygen pressure of $10^{-6}$ atm in order to volatilize arsenic, antimony or bismuth, and that during the same stage at least one gas selected from the group consisting of oxygen and oxygen-enriched air is fed into the lower part of the reaction zone in order to oxidize the concentrate to the desired metal concentration.

2. The process according to claim 1, in which the concentrate and the gas are fed into the uppe part of the reaction zone in such proportions that a temperature of 1200°-1300° C. prevails in the upper part of the reaction zone.

3. The process according to claim 1, in which the gas is fed tangentially into the lower part of the reaction zone.

4. The process according to claim 1, in which the concentrate and the gas are fed tangentially into the upper part of the reaction zone.

5. The process according to claim 1, comprising also feeding a fuel containing carbon into the reaction zone.

6. The process of claim 1, comprising also feeding a fuel containing sulfur to the reaction zone.

* * * * *